US011674470B2

(12) United States Patent
Mandoux et al.

(10) Patent No.: US 11,674,470 B2
(45) Date of Patent: Jun. 13, 2023

(54) ARRANGEMENT TO TRANSMIT DATA FROM AN ECU TO A FUEL INJECTOR

(71) Applicant: Delphi Automotive Systems Luxembourg SA

(72) Inventors: Felix Mandoux, Hettange-Grande (FR); John Mark Dikeman, Burnside, KY (US)

(73) Assignee: DELPHI AUTOMATIVE SYSTEMS LUXEMBOURG SA, Bascharage (LU)

( * ) Notice: Subject to any disclaimer, the term of this patent is extended or adjusted under 35 U.S.C. 154(b) by 0 days.

(21) Appl. No.: 16/756,213

(22) PCT Filed: Oct. 9, 2018

(86) PCT No.: PCT/EP2018/077525
§ 371 (c)(1),
(2) Date: Apr. 15, 2020

(87) PCT Pub. No.: WO2019/076692
PCT Pub. Date: Apr. 25, 2019

(65) Prior Publication Data

US 2021/0189992 A1 Jun. 24, 2021

(30) Foreign Application Priority Data

Oct. 18, 2017 (GB) ..... 1717098

(51) Int. Cl.
*F02D 41/24* (2006.01)
*F02D 41/20* (2006.01)
(Continued)

(52) U.S. Cl.
CPC ..... *F02D 41/2467* (2013.01); *F02D 41/20* (2013.01); *F02D 41/266* (2013.01);
(Continued)

(58) Field of Classification Search
CPC .. F02D 41/20; F02D 41/2058; F02D 41/2089; F02D 41/2093; F02D 41/22;
(Continued)

(56) References Cited

U.S. PATENT DOCUMENTS 5,430,601 A * 7/1995 Burcham ..... F02D 41/20 123/490
9,188,074 B2 * 11/2015 Cheever, Jr. ..... F02D 41/20
(Continued)

*Primary Examiner* — Hung Q Nguyen
*Assistant Examiner* — Johnny H Hoang
(74) *Attorney, Agent, or Firm* — Joshua M. Haines; Bookoff McAndrews, PLLC

(57) ABSTRACT

A system for controlling the operation of one or more fuel injectors includes a microcontroller, a pre-driver unit, and a power unit. The system is connectable to an electrically actuated fuel injector via at least two wires from the power unit, wherein the pre-driver unit is located between the microcontroller and the power stage, and wherein the microcontroller unit is adapted to send data to the pre-driver unit. The pre-driver unit is adapted to receive the data and control the power stage dependent on the data such that the power stage is adapted to output a corresponding signal along the wires to the fuel injector. The data includes both injector activation pulse data and other auxiliary data for the injectors.

13 Claims, 2 Drawing Sheets

(51) Int. Cl.
*F02D 41/28* (2006.01)
*F02D 41/26* (2006.01)

(52) U.S. Cl.
CPC ..... *F02D 41/28* (2013.01); *F02D 2041/2058* (2013.01); *F02D 2041/2093* (2013.01)

(58) Field of Classification Search
CPC ..... F02D 41/24; F02D 41/2467; F02D 41/26; F02D 41/266; F02D 41/28; F02D 2041/2058
See application file for complete search history.

(56) References Cited

U.S. PATENT DOCUMENTS

| | | | | |
|---|---|---|---|---|
| 10,221,800 | B1 * | 3/2019 | Gose | F02D 41/266 |
| 10,371,082 | B1 * | 8/2019 | Dikeman | F02D 41/26 |
| 2009/0287393 | A1 * | 11/2009 | Moller | F02D 41/266<br>123/480 |
| 2010/0269793 | A1 | 10/2010 | Wang et al. | |
| 2014/0121945 | A1 | 5/2014 | Viele | |
| 2014/0150751 | A1 | 6/2014 | Cheever, Jr. et al. | |
| 2015/0115059 | A1 * | 4/2015 | Park | F02D 41/2467<br>239/71 |
| 2017/0292898 | A1 | 10/2017 | Schweikert et al. | |

* cited by examiner

ARRANGEMENT TO TRANSMIT DATA FROM AN ECU TO A FUEL INJECTOR

CROSS REFERENCE TO RELATED APPLICATIONS

This application is a national stage application under 35 USC 371 of PCT Application No. PCT/EP2018/077525 having an international filing date of Oct. 9, 2018, which is designated in the United States and which claimed the benefit of GB Patent Application No. 1717098.6 filed on Oct. 18, 2017, the entire disclosures of each are hereby incorporated by reference in their entirety.

TECHNICAL FIELD

This invention relates to a method and apparatus to transmit serial data between an ECU and an injector. Aspects of the invention use existing control lines.

BACKGROUND OF THE INVENTION

Fuel injectors typically comprise an electrically controlled actuator which is used to control a valve system so as to dispense fuel. The fuel injectors typically also include a logic based secondary functional circuit, used to control the fuel injector. Both are typically connected through the same control wires to an ECU. These wires are used to communicate high power control commands for control of the injector, e.g. by sending an injector activation pulse/profile (which may comprise a series of controlled pulses of an activation pulse) as well as to transmit auxiliary (e.g. serial) data between the ECU and injector logic circuitry by means of serial communication between the ECU. So the auxiliary data may for example comprise any data other than the activation pulse data. This auxiliary data may be variable operating parameters or any other data sent from the ECU to the injector, other than the activation pulse/pulse profile for the current operating cycle of the injector. Reference to "auxiliary data" hereinafter should be interpreted as such. It is to be noted that the term "activation pulse" may be interpreted as one of more pulses with respect to a (current) activation cycle of a fuel injector. The skilled person would understand that such an activation pulse may be comprises of pulses or sets of pulses at different levels including chopped waveforms. Said activation pulse may be regarded more as a pulse profile which may comprise pre-injection pulses, main injection pulses and post injection pulses, each of which may have different degrees of complexity in terms of the voltage waveform levels over time. These activation pulses are sent to activate the fuel injector in the current operating cycle.

A microcontroller in the ECU usually controls the injector pre-driver and power stage via internal control lines, for sending the activation pulse to the injector. In addition, serial transmission is controlled via internal discrete control lines and transformed in a higher power electrical signal by some kind of line driver finally connected to the high power control wires for the injector. The additional line driver requires short circuit protection and diagnostics features in order to comply with international standards and in order to survive normal vehicle operation. The protection and diagnostics circuits add cost and consume board space.

It is an object of the invention to provide an improved system which minimizes hardware requirements.

SUMMARY OF THE INVENTION

In one aspect is provided a system for controlling the operation of one or more fuel injectors comprising a microcontroller, a pre-driver unit and a power unit, said system being connectable to an electrically actuated fuel injector via at least two wires from said power unit, wherein said pre-driver unit is located between said microcontroller and said power stage, and wherein said microcontroller unit is adapted to send data to the pre-driver unit, said pre-driver unit adapted to receive said data and control the power stage dependent on said data such that the power stage is adapted to output a corresponding signal along said wires to the fuel injector; and wherein said data comprises both injector activation pulse data and other auxiliary data for the injector (s).

Said pre-driver unit and power unit may be adapted to send a multiplexed signal along said wires to said injector, said multiplexed signal formulated from said data received from said micro-controller by said pre-driver, and comprising both injection activation pulse and said auxiliary data.

Said multiplexed signal may comprise serially arranged auxiliary data temporally interspersed between activation pulses.

Said microcontroller may be adapted to send both injection activation pulse data and said auxiliary data to said pre-driver unit, said pre-driver unit adapted to control the power stage, such as to send both the injection activation pulse (data) and auxiliary data via said at least two wires.

The system may include a timer module located between said microcontroller and pre-driver, adapted to receive said control data from said microcontroller and convert said control data to provide a sequence command to the pre-driver unit.

Said data may be sent from the microcontroller to the pre-driver comprises both serial data stream and timing data.

Said power stage may include high side drive and low side drive power stages, the outputs of which are connected or connectable to one of each of said wires.

Said pre-driver may be adapted to provide an output command to a high side drive and low side drive power stages.

The pre-driver may include a diagnostic unit adapted to send diagnostic data received from the injector and/or the power stage to the microcontroller.

Said diagnostic unit may be adapted to process said received data received and forward said the resultant processed data to the microcontroller.

BRIEF DESCRIPTION OF THE DRAWINGS

The present invention is now described by way of example with reference to the accompanying drawings in which.

DESCRIPTION OF THE PREFERRED EMBODIMENTS

Prior Art

Figure 1:
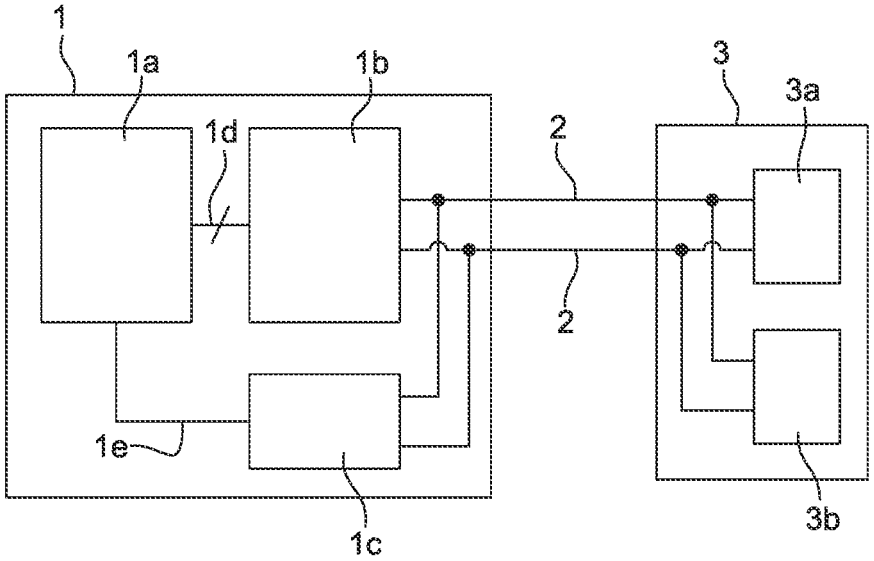
Fig. 1 Prior Art
FIG. 1 shows a prior art fuel injector control system.

FIG. 1 shows a prior art fuel injector control system. The figure shows the injector portion 3 connected to an ECU 1.

The injector contains typically an electrically controlled actuator 3*a* and logic based secondary functional circuit 3*b*. Activation pulses are sent to the actuator and other data are often sent to and from the ECU/injector also such as various data sent to the secondary functional circuit 3*b*. Both 3*a* and 3*b* are typically connected through the same control wires 2 to the ECU. So generally speaking, these wires are used to communicate high power control commands for control of the injector, as well as to transmit data between the ECU and injector logic circuitry by means of serial communication between the ECU.

A microcontroller 1*a* in the ECU usually controls the injector pre-driver and power stage 1*b* via internal control lines 1*d*. In addition, the serial transmission is controlled via internal discrete control lines 1*e* and transformed in a higher power electrical signal by some kind of line driver 1*c* finally connected to the high power control wires 2 for the injector. As mentioned the additional line driver 1*c* for serial trans mission of data requires short circuit protection and diagnostics features in order to comply with international standards and in order to survive normal vehicle operation. The protection and diagnostics circuits add cost and consume board space.

Examples of the Invention

Figure 2:
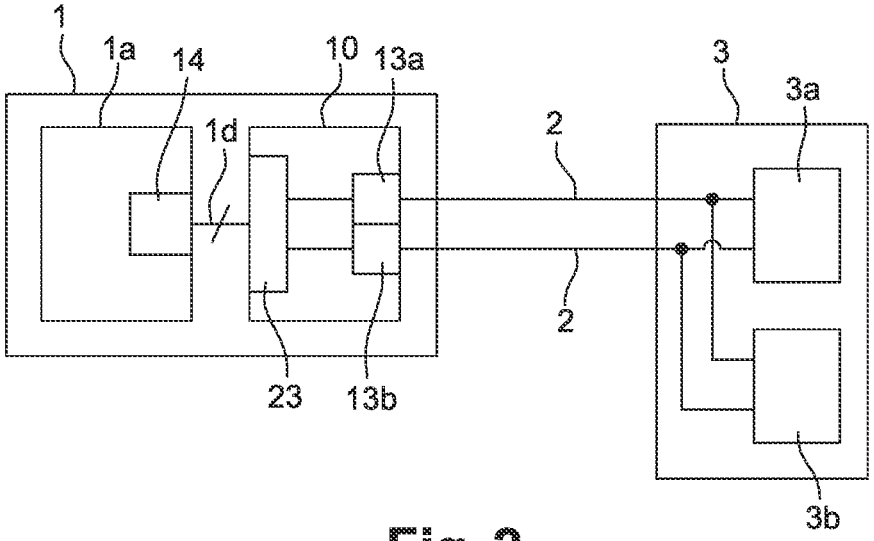
FIG. 2 shows an example of a system according to an example of the invention.

FIG. 2 shows an example of a system according to an example of the invention. The figure is similar to FIG. 1. The injector portion 3 has similar components and reference numerals as in FIG. 1. However the arrangement (e.g. on or in the ECU side) does not include the line driver portion 1*c* but instead includes a modified injector pre-driver and power stage 10, referred to hereinafter when combined as an output driver 10 to generate the both the activation pulse signal as well as a serial communication of other data to be sent to the injector; the external line driver 1*c* (external form the controller) is thus removed.

Figure 3:
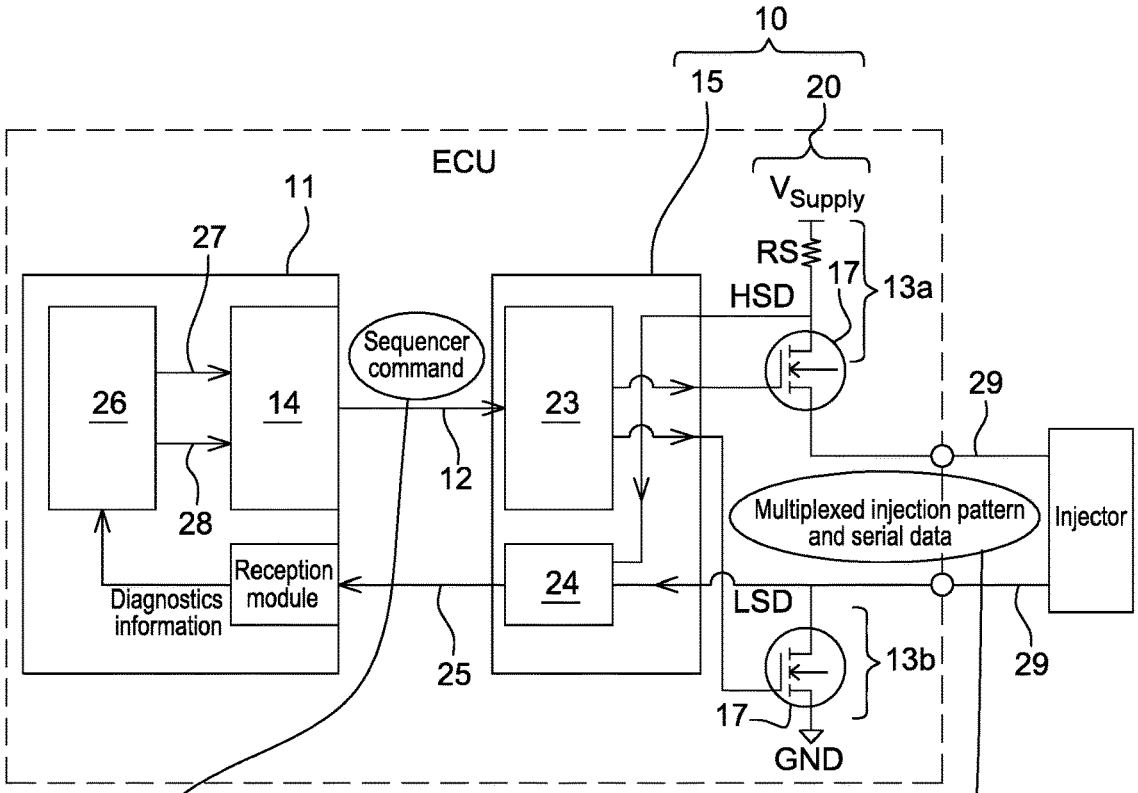
FIG. 3 shows a figure showing the controller and output driver of FIG. 2 in more detail.

FIG. 3 shows the arrangement of FIG. 2 in more detail. The output driver 10 comprises an injector pre-driver 15 located between the ECU and a power stage 20. The pre-driver includes a sequencer 23. The power stage comprises as high side drive and low side drive functional units 13*a* and 13*b*. The microcontroller 11 is also adapted to perform special/additional functions in order to generate control signals such as a sequence command, 12 for the output driver 10 for transmitting serial data through the injector wires to the injector. The microcontroller 11 includes timer modules 14 which are used to generate pulse trains stimulating the output driver 10.

As mentioned FIG. 3 shows a figure showing the controller 11 and output driver 10 in more detail. The output driver includes a pre-driver portion 15 which includes a sequencer unit 16 and uses this to translate command signals from the controller 11; the command signals are translated from a pulse train to a serial data signal signals which are output to output driver 20 which includes FETs 17 in respect of high side and low side drives. Both data with respect to the activation pulse (pulse profile) is sent via lines 12 to the pre-driver as well as other data to be sent to the injector.

The pre-driver may include a diagnostics unit 24 which has input from the injector wires via the high side and low side voltage lines The microcontroller which can be part of the engine ECU includes a reception module to receive diagnostic/serial data 25 from the diagnostics module of the pre-driver to the processing unit. A processing unit 26 includes means to send serial control data stream 27 and timing data (start of communication) 28 to the timer module which processes the data to provide a sequence command signal from the microcontroller timer module to the sequencer. Both processing unit and timer module may be combined to form a unit which essentially is adapted to send activation pulse data as well as other data to the pre-driver where it is processed to activate the power stage and send appropriate signals to the injector.

In operation a sequence command signal 12 is sent form the microcontroller to the pre-driver unit via a timer module of the microcontroller. Serial data stream and timing data is sent from a processing unit to the timer module; where the latter process this and generates the sequence demands for the pre-driver unit. In the output stage the pre-driver uses the sequence data to control the power stage appropriately so that the output of the power stage can transmit pulse signals and other data serially. Thus the output 29 is a multiplexed injection pattern (signal) 30 sent to the to the injector, which can comprise of injection data (activation pulse) and other data such as serial data 29 also be sent to the injectors along the wires 2.

Figure 4:
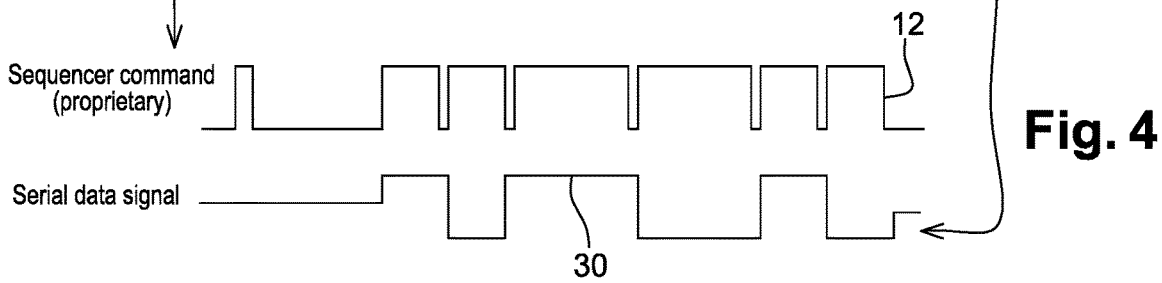
FIG. 4 shows the timelines of pulse trains of the sequencer command and serial data signal sent to the injector form the output stage.

FIG. 4 shows the timelines of pulse trains of the sequencer command 12 (top plot) and serial data 30 signal (bottom plot) sent to the injector form the output stage.

The sequencer command signal may be of any appropriate format according to system and may depend on the architecture of the sequencer itself. The sequencer command signal is synchronized when the communication starts. The bit timing itself is as well already defined at that point in time. The pre-driver provides serial data signal out of the command signal by driving the output driver transistors accordingly.

Figure 5:
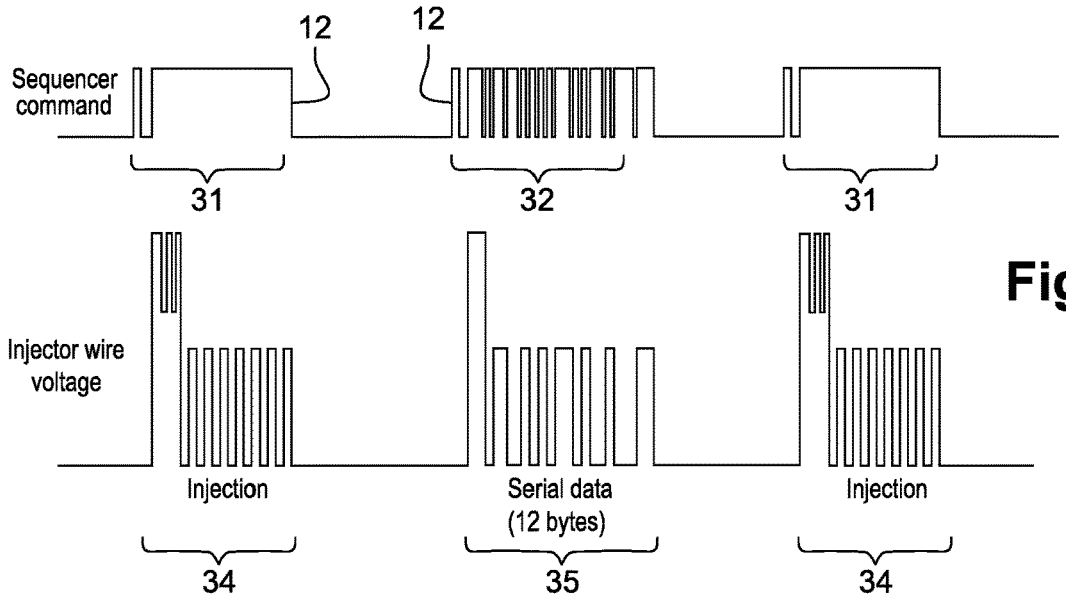
FIG. 5 shows the pulse trains for the two injections and the pulse train for transmission of serial data to the injector.

This mechanism is the same as used for the injector drive, the sequencer is used to drive different signal schemes as for injectors. The plots of FIG. 5 shows how a 2 byte serial communication is done between two injections: the top plot shows sequencer command 12 in respect of two injection (profiles) as well as serial data transmission between the two injections. The portions of the sequencer command controlling injection (pulse/pulse profile (data)) are shown with reference numerals 31 and that for transmission of other auxiliary (serial) data to the injectors is shown with respect to reference numeral 32. Thus this is a multiplexed signal. The injector waveform sequencer command is also generated by the timer module, but using a different timer routine. FIG. 2 bottom plot shows the pulse trains for the two injections (activation pulse/pulse profiles) 34 and the pulse train for transmission of serial (auxiliary) data to the injector 35, i.e. the output 29 which is sent from the output stage to the injectors along wires 2.

A great advantage compared to an external line driver is that the injector driver output stage comes with well performing protections against external electrical overstress. It shuts down automatically when driving into a short circuit and it gives feedback about the availability of the wires to the injector. Short circuit protection and availability information are critical to automotive applications.

External line drivers are usually not sufficiently protected against external electrical overstress. So additional components are required. In addition, they do usually not give any feedback about the line status.

The output power stage (1*b*) is anyway protected against external electrical overstress and comes with powerful diagnostics features which as well operate while transmitting serial data. As shown in FIG. 3, the pre-driver does diagnose the injector wire line by measuring the voltage across the transistors. If the device drives into a short, the current is high and the diagnosed voltage therefore as well. The pre-driver can then protect the output stage by disabling the output driver transistors on time. In addition it communicates to the processor via a serial line so that remedial actions can be taken. This way of diagnosing is state of the art on power outputs, but unusual on serial data drivers.

The invention allows implementation of serial transmission without hardware any overhead, so with lower space requirements and lower cost. It requires a complex timer routine in the microcontroller in order to drive the pre-driver sequencer such that the driver sends out serial data.

The invention claimed is:

1. A system for controlling operation of an electrically actuated fuel injector, the system comprising:

a microcontroller;

a pre-driver unit; and a power unit; wherein:

said system is configured to be connected to said electrically actuated fuel injector via two wires from said power unit;

said pre-driver unit is connected between said microcontroller and said power unit;

said microcontroller is configured to send data to the pre-driver unit;

said data comprises both injector activation pulse data and auxiliary data for the electrically actuated fuel injector, wherein the auxiliary data is not an activation pulse;

said pre-driver unit is configured to receive said data and control the power unit dependent on said data such that the power unit is configured to output a corresponding signal along both a first wire of said two wires to the electrically actuated fuel injector such that said injector activation pulse data is sent to said electrically actuated fuel injector along the first wire of said two wires and such that said auxiliary data is sent to said electrically actuated fuel injector along the first wire of said two wires; and wherein said auxiliary data is sent asynchronously in time relative to when said activation pulse data is sent on the first wire of the two wires.

2. A system as claimed in claim 1, wherein said pre-driver unit and said power unit are configured to send a multiplexed signal along said two wires to said electrically actuated fuel injector, said multiplexed signal formulated from said data received from said microcontroller by said pre-driver unit, and comprising both said injection activation pulse data and said auxiliary data.

3. A system as claimed in claim 2, wherein said multiplexed signal comprises serially arranged auxiliary data temporally interspersed between activation pulses.

4. A system as claimed in claim 1, where said microcontroller is configured to send both said injection activation pulse data and said auxiliary data to said pre-driver unit, said pre-driver unit configured to control the power unit, so as to send both the injector activation pulse data and the auxiliary data via said two wires.

5. A system as claimed in claim 1, further comprising a timer module located between said microcontroller and said pre-driver unit, said timer module configured to receive said data from said microcontroller and convert said data to provide a sequence command to the pre-driver unit.

6. A system as claimed in claim 1, wherein said data sent from the microcontroller to the pre-driver unit comprises both serial data stream and timing data.

7. A system as claimed in claim 1, wherein said power unit includes a high side drive power stage and a low side drive power stage, the outputs of which are connected to one of each of said two wires.

8. A system as claimed in claim 1, wherein said pre-driver unit is configured to provide an output command to a high side drive power stage and to a low side drive power stage.

9. A system as claimed in claim 1, wherein the pre-driver unit includes a diagnostic unit configured to send diagnostic data received from the electrically actuated fuel injector and/or the power unit to the microcontroller.

10. A system as claimed in claim 9, wherein said diagnostic unit is configured to process said diagnostic data and forward said a resultant processed data to the microcontroller.

11. A system as claimed in claim 1, wherein said pre-driver unit is configured to send said auxiliary data to said electrically actuated fuel injector via said power unit along said two wires.

12. A system as claimed in claim 1, wherein said auxiliary data and said injector activation pulse data are sent along a given wire of the two wires at separate times.

13. A system as claimed in claim 1, wherein said pre-driver unit is configured to receive said data and control the power unit dependent on said data such that the power unit is configured to output an additional corresponding signal along a second wire of said two wires to the electrically actuated fuel injector such that said injector activation pulse data is sent to said electrically actuated fuel injector along the second wire of said two wires and such that said auxiliary data is sent to said electrically actuated fuel injector along the second wire of said two wires.

* * * * *